US007622236B2

(12) United States Patent
Landa et al.

(10) Patent No.: US 7,622,236 B2
(45) Date of Patent: Nov. 24, 2009

(54) LIQUID TONER WITH ADDITIVES FOR ENHANCING LIFE OF INTERMEDIATE TRANSFER MEMBERS

(75) Inventors: Benzion Landa, Nes-Ziona (IL); Albert Teishev, Rishon-Lezion (IL); Michael German, Upland, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 444 days.

(21) Appl. No.: 10/483,510

(22) PCT Filed: Jul. 15, 2002

(86) PCT No.: PCT/IL02/00568

§ 371 (c)(1),
(2), (4) Date: Jan. 12, 2004

(87) PCT Pub. No.: WO03/009064

PCT Pub. Date: Jan. 30, 2003

(65) Prior Publication Data

US 2004/0219449 A1 Nov. 4, 2004

(30) Foreign Application Priority Data

Jul. 15, 2001 (IL) ..... 144326

(51) Int. Cl.
*G03G 9/125* (2006.01)

(52) U.S. Cl. ..... 430/115; 430/116

(58) Field of Classification Search ..... 430/112, 430/115, 116, 117, 118.6, 119.4; 508/207, 508/208; 510/407, 285
See application file for complete search history.

(56) References Cited

U.S. PATENT DOCUMENTS

| | | | | | |
|---|---|---|---|---|---|
| 3,885,965 | A | * | 5/1975 | Hughes et al. | 430/448 |
| 4,177,177 | A | * | 12/1979 | Vanderhoff et al. | 523/300 |
| 4,182,398 | A | * | 1/1980 | Salyer et al. | 165/104.31 |
| 4,235,743 | A | | 11/1980 | Canevari | |
| 4,613,646 | A | | 9/1986 | Sandvick | |
| 4,693,840 | A | * | 9/1987 | Trinh et al. | 510/242 |
| 4,980,259 | A | | 12/1990 | Landa et al. | 430/117 |
| 4,984,025 | A | | 1/1991 | Landa et al. | |
| 5,028,964 | A | | 7/1991 | Landa et al. | |
| 5,069,995 | A | * | 12/1991 | Swidler | 430/115 |
| 5,130,041 | A | * | 7/1992 | Groenhof | 252/78.3 |
| 5,155,534 | A | | 10/1992 | Kurotori et al. | 430/117 |
| 5,206,107 | A | | 4/1993 | Pearlstine | 430/115 |
| 5,208,130 | A | | 5/1993 | Almog et al. | 430/115 |
| 5,232,811 | A | * | 8/1993 | deGraft-Johnson et al. | 430/115 |
| 5,254,427 | A | | 10/1993 | Lane et al. | 430/114 |
| 5,300,390 | A | | 4/1994 | Landa et al. | 430/115 |
| 5,346,796 | A | | 9/1994 | Almog et al. | 430/115 |
| 5,410,392 | A | | 4/1995 | Landa et al. | |
| 5,459,008 | A | | 10/1995 | Chambers et al. | 430/126 |
| 5,555,185 | A | | 9/1996 | Landa et al. | |
| 5,592,269 | A | | 1/1997 | Younes et al. | 399/237 |
| 5,636,349 | A | | 6/1997 | Landa et al. | 399/307 |
| 5,745,829 | A | | 4/1998 | Gazit et al. | 399/302 |
| 5,754,931 | A | | 5/1998 | Castelli et al. | 399/297 |
| 5,761,595 | A | | 6/1998 | Tarnawskyj et al. | 399/308 |
| 5,955,236 | A | | 9/1999 | Bower | 430/115 |
| 6,074,444 | A | | 6/2000 | Bingley | |
| 6,087,073 | A | | 7/2000 | Bennett et al. | 430/303 |

FOREIGN PATENT DOCUMENTS

| | | |
|---|---|---|
| JP | 4100061 | 4/1992 |
| WO | WO9008348 | 7/1990 |
| WO | WO9613760 | 5/1996 |
| WO | WO 97/07433 | 2/1997 |
| WO | WO9806010 | 2/1998 |
| WO | WO 98/55901 | 12/1998 |
| WO | WO 00/31593 | 6/2000 |

OTHER PUBLICATIONS

Daniels, F. et al., *Physical Chemistry*, John Wiley & Sons, Inc., NY (1966), pp. 383-384.*
American Chemical Society (ACS) File Registry No. RN 42557-10-8 on STN, entered in STN on Nov. 16, 1984, copyright 2006.*
Whelan, T, consultant, *Polymer Technology Dictionary*, Chapman & Hall, NY (1994), p. 30.*
Whelan, T, consultant, *Polymer Technology Dictionary*, Chapman & Hall, NY (1994), p. 256.*
Kosinski, L.E., et al., Rheologica Acta, vol. 25, No. 2, (1986), pp. 153-160.*
Dow Corning® 200 Fluid Product Information, Ref. No. 22-0069N-01, Dow Corning Corporation, copyright 1997-2000, pp. 1-6.*

* cited by examiner

*Primary Examiner*—Janis L Dote

(57) ABSTRACT

A liquid toner or toner concentrate comprising: pigmented toner particles in an amount of 0.5% to 20% by weight; a carrier liquid comprising: a liquid hydrocarbon; a silicone based additive; and a charge director, wherein the silicone based additive comprises a release life enhancer additive chosen from the group consisting of: a liquid silicone material having a viscosity of at least 5,000 centistokes; a silicone gum; a silicone surfactant; and a non-reactive silicone fluid.

20 Claims, No Drawings

LIQUID TONER WITH ADDITIVES FOR ENHANCING LIFE OF INTERMEDIATE TRANSFER MEMBERS

RELATED APPLICATIONS

The present application is a U.S. national application of PCT Application No. PCT/IL02/00568, filed on Jul. 15, 2002.

FIELD OF THE INVENTION

The invention relates to imaging utilizing liquid toners and in particular to liquid toners with additives for enhancing the life of intermediate transfer members utilized in said imaging.

BACKGROUND OF THE INVENTION

Liquid toner imaging (printing and copying) systems that utilize intermediate transfer members are well known. Representative systems are described in U.S. Pat. Nos. 4,984,025; 5,028,964; 5,555,185; 5,410,392; 5,636,349; and many other patents and patent applications assigned to the assignee of the present application, the disclosures of which are incorporated herein, by reference. Such systems contain an intermediate transfer member (ITM) that receives a liquid toner image from one surface (for example, a surface on which the image is formed) and from which the image is transferred (for example, to a final substrate).

In general, transfer to ITMs is by electrical attraction of the charged toner particles from the image forming surface. This, first, transfer may be aided by heat. In many systems first transfer requires conformance between the surface of the ITM and the image forming surface, under low pressure. In many systems, the image is heated on the ITM so that it coalesces. The image is generally transferred to the final substrate by heat and pressure (hereinafter "second transfer").

In order to perform its tasks, the ITM is generally required to meet a number of physical requirements. These include release requirements of the surface of the ITM (hereinafter the "release surface" or "release layer") for release of the image from the intermediate transfer member to the final substrate (or to a second ITM). Suitable release layers are described in the above referenced references and generally include a silicone layer of specified construction.

However, one of the major limitations of such release layers is a gradual loss of release properties which results in incomplete transfer of the image to the final substrate. Such incomplete transfer, in addition to causing a reduction in quality of the image, also requires that the ITM be cleaned after each second transfer cycle, a process that greatly complicates the system. Furthermore, such continuous cleaning further reduces the life of the transfer surface.

Representative intermediate transfer members are described in the above referenced patents and applications and in U.S. Pat. Nos. 5,754,931; 5,592,269 and 5,745,829 and published applications WO 97/07433; WO 98/55901 and WO 00/31593, the disclosures of all of which are incorporated herein by reference.

Representative systems that incorporate the technology described in at least some of these and many other patents and patent applications include EBONY, E-PRINT PRO+; TURBOSTREAM, ULTRASTEAM 200 and 400 and PUBLISHER 2000 and 4000, OMNIUS WEBSTREAM, WEBSTREAM 100, WEBSTREAM 200, WEBSTREAM 400 and OMNIUS MULTISTREAM produced and marketed by Indigo NV, a subsidiary of The Hewlett-Packard Company, the assignee of this application.

PCT Publication WO 96/13760 (now U.S. patent application Ser. No. 08/809,419), the disclosure of which is incorporated herein by reference, describes a liquid toner in which a two component carrier liquid is used. The carrier liquids are adsorbed or solvated by the release surface. The major component of the carrier liquid has a relatively higher volatility that the minor component of the carrier liquid. During operation, the less volatile component remains adsorbed in the release layer to reduce inter alia the drying out of the layer. This improves the release of the layer and the gloss of the resultant image. It also results in some increased release layer life.

U.S. Pat. No. 5,300,390, the disclosure of which is incorporated herein by reference describes a liquid toner with improved cohesivity. This increased cohesivity improves the transfer efficiency of the image. In particular, this patent describes the use of non-soluble ground silicone gels or silicone oils. The silicone gels are present in an amount of between 1-30% by weight of gel to toner particles and the silicone oil in an amount of 5% by weight with respect to the toner particles.

SUMMARY OF THE INVENTION

An aspect of some embodiments of the present invention relates to the addition of a release life enhancer additive comprising a silicone copolymer soluble in the carrier liquid or a silicone fluid to the carrier liquid. In exemplary embodiments of the invention, the additives are silicone based compounds having non-polar functional groups. In general, the release life enhancer additives are soluble in or miscible with the carrier liquid. The release life enhancer additives are designated as such, not because they are necessarily present in a high percentage, but because they are believed to have a major effect of increasing blanket life.

A first exemplary release life enhancer additive is a silicone fluid, such as polydimethylsiloxane fluid (which may be supplied by DOW CORNING or ABCR GmbH & Co. of Germany) having a viscosity at approximately 25.degree. C. of between about 5,000 to 2,500,000 (or higher, if available) centistokes and a molecular weight of between about 50,000 and 500,000 (or higher, if available). Most preferably, the viscosity is above 250,000 centistokes. In general, higher values of viscosity and molecular weight are preferred. This material can be considered to be a silicone oil and more specifically a liquid siloxane oil.

An example of this first exemplary additive is trimethylsiloxy terminated Polydimethylsiloxane, having ABCR GmbH catalog number DMS-T63. This material has a molecular of 400,000-500,000 (about 450,000) and a viscosity of 2,500,000 centistokes. Materials with higher viscosity and molecular weight can also be used, if available. Other materials of this class can also be used. These include DMS-T35 having a viscosity of 5000 and a molecular weight of about 50,000, DMS-T51 (V=100,000; MW=139,000) and DMS-T53 (V=300,000, MW=204,000). Materials with intermediate viscosities and molecular weights are also useful in the practice of the invention.

A second exemplary release life enhancer additive is a silicone gum, for example a gum having a polydimethylsiloxane chain, such as a polydimethyldiphenylmethylvinylsilioxane gum sold under the trademark MIRASIL (Rodia, GAS No. 67762-99-6). Applicants have found that this particular gum does not cause foaming. However, other gums may be used.

A third exemplary release life enhancer additive is Silicone copolymer surfactant of pendant type with propylene oxide functional groups. Such material is produced by Witco Corp. as SILWET L-7510 and has a molecular weight of 13000. Other pendant type polymer surfactants are also useful. While other surfactant types can be used, pendent types do not cause substantial foaming.

A fourth exemplary material is Alkyl-modified non-reactive silicone fluid. This material is produced by Shin-Etsu Corporation and marketed asunder the trademark KLF-412. This material has a molecular weight of 10,000 and 20,000 and a viscosity of 500 centistokes. Possibly, lower molecular weight materials can be used. The alkyl modification reduces foaming, but other non-reactive silicone fluids can be used.

All of these materials are believed to operate in a similar way. Namely they are substantially non-volatile (at the temperature of the intermediate transfer blanket) and they have an affinity for the silicone release coating of the intermediate transfer member. In use they are believed to have a high viscosity, which aids in their stability on the blanket. Without limiting the scope of the invention by any theory of operation, these materials are believed to form a thin protective layer on the blanket that protects the blanket's release properties.

In some embodiments of the invention, especially when an oil is used as the additive (for example, polydimethylsiloxane fluid, as described above) an additional defoaming additive may be added to reduce foaming caused by the oil. An exemplary material is a gel (soluble finely dispersed in the carrier liquid) produced by Shin-Etsu Corporation and marketed under the trademark KSG15. This material comprises Dimethicone/Vinyl Dimethicone Crosspolymer with Cyclopentasiloxane.

Additionally, the carrier liquid can comprise a low volatility carrier liquid component such as MARCOL 82 (a product of the EXXON Corporation) as described in PCT Publication WO 96/13760, referenced above or Drakel DRAKOL 35 (sold by Penreco).

There is thus provided, in accordance with an exemplary embodiment of the invention, a liquid toner or toner concentrate comprising:

pigmented toner particles in an amount of 0.5% to 20% by weight;

a carrier liquid comprising:

a liquid hydrocarbon;

a silicone based additive; and a charge director, wherein the silicone additive comprises a release life enhancer additive chosen from the group consisting of:

a liquid silicone material having a viscosity of at least 5,000 centistokes;

a silicone gum;

a silicone surfactant; and a non-reactive silicone fluid.

In an embodiment of the invention, the silicone additive comprises a liquid silicone material having a viscosity of at least 5,000 centistokes, alternatively at least 10,000, 50,000, 100,000, 350,000, 500,000, 1,000,000, 2,000,000, alternatively about 2,500,000 centistokes.

Optionally, the liquid silicone material has an average molecular weight of about 50,000 or more, alternatively, 130,000 or more, alternatively, about 200,000 or more, alternatively, more than about 400,000.

In an embodiment of the invention, the liquid silicone material is a silicone oil, for example a siloxane oil. In an embodiment of the invention, the liquid silicone material comprises a polydimethyl siloxane chain. In an embodiment of the invention, the material is trimethylsiloxy terminated Polydimethylsiloxane. Optionally, the silicone based additive is present in a ratio of between 0.001% and 0.1% by weight of additive to carrier liquid, alternatively, the ratio is 0.002% to 0.05% or 0.005% to 0.01%.

In an embodiment of the invention, the silicone additive comprises a silicone gum. Optionally, the silicone gum comprises a polydimethyl siloxane chain. Optionally, the silicone gum comprises polydimethyldiphenylmethylvinylsilioxane gum. Optionally, the additive is present in the carrier liquid in a ratio of between 0.001% and 0.1% by weight.

In an embodiment of the invention, the additive comprises a silicone surfactant. Optionally, the surfactant is a surfactant of the pendant type. Optionally, the surfactant is a silicone copolymer with propylene oxide functional groups. Optionally, the additive is present in a concentration of 0.01 to 2% by weight to weight of hydrocarbon liquid.

In an embodiment of the invention, the additive comprises a non-reactive silicone fluid. Optionally, the additive is a alkyl modified non-reactive silicone fluid. Optionally, the non-reactive fluid has a molecular weight of between 10,000 and 20,000. Optionally, the silicone fluid has a viscosity of about 500 centistokes. Optionally, the additive is present in a ratio of between 0.01% and 2%, by weight to carrier liquid.

In an embodiment of the invention, the toner further comprises a defoaming agent. Optionally, the defoaming agent is present in a ratio of 0.0002%-0.002% by weight of non-volatile solids in the defoaming agent with respect to the carrier liquid. Optionally, the defoaming agent comprises a gel. Optionally, the gel is a finely ground gel. Optionally, the defoaming agent comprises Dimethicone/Vinyl Dimethicone Crosspolymer with Cyclopentasilicone.

In an embodiment of the invention, the liquid hydrocarbon comprises a major part of a first liquid hydrocarbon and a minor part of a second hydrocarbon, where the second hydrocarbon has an evaporation rate of less than 10% of the first hydrocarbon. Optionally, the second liquid hydrocarbon is present in a ratio of 2% or less than the first hydrocarbon, or in a ratio of between 0.2% and 1%.

There is further provided a printing method in which a toner image is produced on a first surface and transferred to a final substrate via an intermediate transfer member having a silicone release layer, the method characterized by the toner being a toner according to the invention. Optionally, the release life enhancer additive coats the release layer during said printing method with a release protecting layer, that remains on the release layer after the image is transferred therefrom.

There is further provided, in accordance with an embodiment of the invention, a printing method in which a toner image is produced on a first surface and transferred to a final substrate via an intermediate transfer member having a silicone release layer, the method characterized by the toner having a non-volatile containing a release life enhancer additive that remains on and coats the intermediate transfer layer after the image is transferred therefrom.

Optionally, the release life enhancer additive is substantially non-volatile at temperatures encountered during the printing process.

There is further provided, in accordance with an embodiment of the invention, a composition of matter comprising a mixture of:

a liquid hydrocarbon; and a silicone additive, wherein the silicone additive comprises a release life enhancer additive chosen from the group consisting of:

a liquid silicone material having a viscosity of at least 5,000 centistokes;

a silicone gum;

a silicone surfactant; and a non-reactive silicone fluid.

In an embodiment of the invention, the silicone additive comprises a liquid silicone material having a viscosity of at least 5,000 centistokes, alternatively at least 10,000, 50,000, 100,000, 350,000, 500,000, 1,000,000, 2,000,000, alternatively about 2,500,000 centistokes.

Optionally, the liquid silicone material has an average molecular weight of about 50,000 or more, alternatively, 130,000 or more, alternatively, about 200,000 or more, alternatively, more than about 400,000.

In an embodiment of the invention, the liquid silicone material is a silicone oil, for example a siloxane oil. In an embodiment of the invention, the liquid silicone material comprises a polydimethyl siloxane chain. In an embodiment of the invention, the material is trimethylsiloxy terminated Polydimethylsiloxane. Optionally, the silicone based additive is present in a ratio of between 0.001% and 0.1% by weight of additive to carrier liquid, alternatively, the ratio is 0.002% to 0.05% or 0.005% to 0.01%.

In an embodiment of the invention, the silicone additive comprises a silicone gum. Optionally, the silicone gum comprises a polydimethyl siloxane chain. Optionally, the silicone gum comprises polydimethyldiphenylmethylvinylsilioxane gum. Optionally, the additive is present in the carrier liquid in a ratio of between 0.001% and 0.1% by weight.

In an embodiment of the invention, the additive comprises a silicone surfactant. Optionally, the surfactant is a surfactant of the pendant type. Optionally, the surfactant is a silicone copolymer with propylene oxide functional groups. Optionally, the additive is present in a concentration of 0.01 to 2% by weight to weight of hydrocarbon liquid.

In an embodiment of the invention, the additive comprises a non-reactive silicone fluid. Optionally, the additive is a alkyl modified non-reactive silicone fluid Optionally, the non-reactive fluid has a molecular weight of between 10,000 and 20,000. Optionally, the silicone fluid has a viscosity of about 500 centistokes. Optionally, the additive is present in a ratio of between 0.01% and 2%, by weight to carrier liquid.

In an embodiment of the invention, the composition of matter further comprises a defoaming agent. Optionally, the defoaming agent is present in a ratio of 0.0002%-0.002% by weight of non-volatile solids in the defoaming agent with respect to the carrier liquid. Optionally, the defoaming agent comprises a gel. Optionally, the gel is a finely ground gel. Optionally, the defoaming agent comprises Dimethicone/Vinyl Dimethicone Crosspolymer with Cyclopentasilicone.

In an embodiment of the invention, the liquid hydrocarbon comprises a major part of a first liquid hydrocarbon and a minor part of a second hydrocarbon, where the second hydrocarbon has an evaporation rate of less than 10% of the first hydrocarbon. Optionally, the second liquid hydrocarbon is present in a ratio of 2% or less than the first hydrocarbon, or in a ratio of between 0.2% and 1%.

There is further provided, in accordance with an embodiment of the invention, a method of replenishing toner in a liquid toner printing machine, comprising:

determining a volume of liquid toner in a reservoir; and adding a composition of matter according to the invention to the liquid toner, responsive to the determination of volume.

DESCRIPTION OF EXEMPLARY EMBODIMENTS

In exemplary embodiments of the invention a toner is produced by the following method:

1) A release life enhancer additive component is mixed with a liquid carrier.

2) An optional defoaming additive is added to the mixture produced in 1, depending on the choice of first additive.

3) An optional low-volatility carrier-liquid component is added and the result is diluted to a desired concentration by addition of the major carrier-liquid component. However, it has been found that release life enhancer additive precipitation may be caused at high concentrations. This potential problem is generally avoided when the alternative production technique described below is used.

4) The result of 3 is added to a prepared dispersion or mixture of toner particles in carrier liquid and charge director.

Alternatively, the optional low volatility carrier liquid component is added to the release life enhancer additive mixture. Then, the release life enhancer additive mixture and the defoaming agent are added separately to the prepared dispersion or mixture of toner particles in carrier liquid and charge director, to achieve a desired concentration of additives. Of course if the optional defoaming agent is not used, the process is simpler.

Preparation of Additives

The following describes each of these acts and include a description of an exemplary liquid toner for use in 4. It should be understood that this toner is only exemplary and that the additives of the present invention, and especially the release life enhancer additives can be used in a wide range of liquid toners.

A release life enhancer additive is added to the carrier liquid used in the liquid toner to which the additive solution is to be added in 4.

An exemplary release life enhancer additive is a silicone fluid such as polydimethylsiloxane fluid (such as supplied by DOW CORNING or ABCR GmbH & Co. of Germany) having a room temperature (about 25 degrees Celsius) viscosity of between about 5,000 to 2,500,000 (or higher, if available) centistokes and a molecular weight of between about 50,000 and 500,000 (or higher, if available). Most preferably, the viscosity is above 250,000 centistokes. In general, higher values of viscosity and molecular weight are preferred.

An exemplary material is trimethylsiloxy terminated Polydimethylsiloxane, having ABCR & Co. catalog number DMS-T63. This material has a molecular weight of 400,000-500,000 (about 450,000) and a viscosity of 2,500,000 centistokes. This material, is added to ISOPAR-L (sold by the Exxon Corporation) an isoparaffinic hydrocarbon fraction, the major carrier liquid component in the toner example given below. The proportion of additive to ISOPAR-L is preferably between 2-15% by weight. These proportions are chosen for convenience of arriving at the desired proportions of additive in the liquid toner. In general the (non-volatile) proportion of additive to carrier liquid in the liquid toner ranges from between 0.001% to 0.1% by weight. These small proportions of additive (0.002-0.05% are exemplary value for this additive) are believed to be surprisingly effective due to the formation of a surface protective layer of protective silicone material non-polar functional groups, which prevent deterioration of the release properties of the toner from the ITM. It is noted that this is only a theory of operation and its exposition is not meant to limit the scope of the invention. Larger or smaller proportions in this first admixture may be used. The temperature at mixing may be increased to 100 to 120 degrees Celsius to facilitate mixing, for example in a Ross Double Planetary Mixer. Heating is desirable due to the high viscosity of the materials. Heating reduces the viscosity and makes mixing easier. However, in an exemplary embodiment of the invention, the carrier liquid (e.g., ISOPAR-L) and the additive are mixed for 1-3 hours in an attritor at 30 to 50 degrees Celsius.

Materials with higher viscosity and molecular weight can also be used, if such are available. Other materials of this class can also be used. These include DMS-T35 having a viscosity of 5000 and a molecular weight of about 50,000, DMS-T51 (V=100,000; MW=139,000) and DMS-T53 (V=300,000, MW=204,000). Materials with intermediate viscosities and molecular weights are also useful in the practice of the invention.

A second exemplary release life enhancer additive is a silicone gum, for example a gum having a poly dimethyl siloxane chain, such as MIRASIL polydimethyldiphenylmethylvinylsilioxane gum (produced by Rodia, CAS No. 67762-99-6). This material is added to (and dissolved in) the carrier liquid in much the same way as with the trimethylsiloxy terminated Polydimethylsiloxane. The final concentration of this material in the carrier liquid of the liquid toner is between 0.001%-0.1%, by weight. Applicants have found mat this particular gum does not cause foaming. However, other gums may be used.

A third exemplary material is a liquid silicone copolymer surfactant of pendant type with propylene oxide functional groups. Such material is produced by Witco as SILWET L-7510 and has a molecular weight of 13000. This material is added to the carrier liquid in much the same way as with the trimethylsiloxy terminated Polydimethylsiloxane, except that, generally, no heating is used. The final concentration of this material in the carrier liquid of the liquid toner is between 0.01%-2%, by weight to carrier liquid. This material is added to the carrier liquid in much the same way as with the trimethylsiloxy terminated Polydimethylsiloxane. Other pendant type polymer surfactants are also useful. While other surfactant types can be used, pendent types do not cause substantial foaming.

A fourth exemplary material is Alkyl-modified non-reactive silicone fluid. This material is produced by the Shin-Etsu Corporation and marketed under the trademark KF-412. This material has a molecular weight of 10,000 and 20,000 and a viscosity of 500 centistokes. This material is added to the carrier liquid in much the same way as with the trimethysiloxy terminated Polydimethylsiloxane. The final concentration of this material in the carrier liquid of the liquid toner is between 0.01%-2%, by weight to carrier liquid.

For the polydimethylsiloxane fluid, especially in larger concentrations, a defoaming agent may be added to solution produces in the above mixing process. An exemplary defoaming material is a gel dispersible in the carrier liquid produced by the Shin-Etsu Corporation and marketed under the trademark KSG15. This material comprises Dimethicone/Vinyl Dimethicone Crosspolymer with Cyclopentasilicone. The concentration of this component (where present) is generally within the range of about 0.0002%-0.0015% or 0.002% by weight of non-volatile solids (approximately equivalent to between 0.001 and 0.1% of total amount of the gel) with respect to the carrier liquid. This material presumably increases the surface tension of the toner and reduces foaming. While for the specific other release life enhancer additives disclosed, there does not appear to be a need for a defoaming agent, other suitable similar materials may need such an agent.

The defoaming agent may be prepared for use in the toner by grinding the gel in an attritor at 4-8% (larger and small percentages can be used) of non-volatile material at 20-40 degrees centigrade for 2-5 hours. The amount of grinding and the exact conditions are not critical. Grinding helps to provide reproducible defoaming action at very low concentrations.

Preparation of Toner

An exemplary toner can be prepared by loading 1020 grams of NUCREL 699 resin (an ethylene methacrylic acid copolymer by Dupont), 120 grams of AC5120 resin (an ethylene acrylic acid copolymer by Allied Signal) with 60 grams of LOTADAR 8200 (maleic anhydride terpolymer by Atochem) and 1800 grams of ISOPAR-L (supplied by the Exxon Corporation) an isoparaffinic hydrocarbon fraction in a ROSS double planetary mixer, preheated by a heating bath, set to 150.degree. C. The ingredients are mixed for about 1.5 hours at speed control setting 3. The speed is increased to a speed setting of 6 for 30 minutes, the heating is stopped and the mixer is cooled with a fan while mixing is continued. The result is a pasty material.

836.30 grams of the pasty material are loaded into a 1S ATTRITOR (Union Process) with 3/16" (three-sixteenths inch) chrome steel grinding media, together with 67.07 grams of HELLIOGEN BLUE pigment 7080 (from the BASF Corporation), 7.45 grams of HELLIOGEN GREEN pigment (BASF), 4.14 grams of aluminum stearate (Riedel de Haen) and 1384.07 grams of ISOPAR-L. The material is ground at 40.degree. C. for 20 hours. The result is discharged from the ATTRITOR (product of Union Process, Inc.) and mixed with an amount of ISOPAR-L to form a working dispersion. The toner is charged utilizing a charge director, preferably a charge director described in U.S. Pat. No. 5,346,796 (the disclosure of which is incorporated by reference), and containing 30 parts by weight lecithin, 30 parts by weight Basic Barium Petronate (BBP) and 6 parts by weight isopropylamine dodecylbenzesulfonate (ICI G3300B) as a stabilizer. The charge director, dissolved in ISOPAR-L is added in an amount of about 30-40 mg of solids of the charge director per gram of toner solids.

An additive solution, as described above, is added to this mixture in an amount sufficient to provide additives having a proportion given above in the liquid toner. In an exemplary embodiment of the invention, a small amount of a low volatility carrier liquid (mineral oil) such as MARCOL 82, such as 2% of the carrier liquid in the final toner, may be added to the carrier liquid before adding the other additive or additives, to form a mixed carrier liquid, as described in the above reference. In practice, smaller amounts such as between 0.2% and 1% (optionally, 0.8%) can be used. In general, it is convenient to add the low volatility oil to the high molecular weight silicone oil mixture and then to this mixture and the defoaming agent mixture separately to the toner to reach desired concentrations of various additives.

In exemplary embodiments of the invention, the high molecular weight silicone oil is present in a percentage of between 0.001 and 0.1% by weight ratio of the oil to the carrier liquid. For all intents and purposes, in the context of liquid toner printing, the oil is not volatile as compared with the carrier liquid, since at temperatures normally encountered in liquid toner printing (up to at least 200 decrees centigrade) it has negligible vapor pressure. Optionally, the percentage is between 0.005 and 0.01%. In a particular embodiment the percentage is 0.007%. It is noted that these amounts are extremely small, especially considering that the operation of this additive is believed to be primarily physical in nature, rather than chemical.

In exemplary embodiments of the invention, the non-volatile material in the foaming agent to the weight of carrier liquid is present in a percentage of between 0.0002 and 0.1%. Optionally, the range is between 0.001 and 0.1%. It has however, been found that, very small amounts of defoaming agent, for example between 0.0002 and 0.0015% are present. In a particular embodiment, 0.00051% was found to be sufficient.

It is noted that for the other release life enhancer additives, the defoaming agent is not required. However, the mixture of carrier liquids, as described above may still be used, although different percentages may be suitable for different amounts and types of release life enhancer additive.

The result is a cyan toner having a relatively high pigment concentration.

A second exemplary toner, can be prepared by loading 960 grams of NUCREL 699 resin (an ethylene methacrylic acid copolymer by Dupont), 240 grams of AC5120 resin (an ethylene acrylic acid copolymer by Allied Signal) 1800 grams of ISOPAR-L (Exxon) in a ROSS double planetary mixer, preheated by a heating bath, set to 150.degree. C. The ingredients are mixed for about 1.5 hours at speed control setting 3. The speed is increased to a speed selling of 6 for 30 minutes, the heating is stopped and the mixer is cooled with a fan while mixing is continued. The result is a pasty material.

971.75 grams of the pasty material are loaded into a 1S ATTRITOR (sold by Union Process, Inc.) with 3/16" (three-sixteenths inch) chrome steel grinding media, together with 55.66 grams of HELLIOGEN BLUE pigment 7080 (BASE), 4.14 grams of HELLIOGEN GREEN pigment (BASE), and 11.5 grams of aluminum stearate (Riedel de Haen) and 1257 grams of ISOPAR-L. The material is ground at 58.degree. C. for about 1.5 hours, followed by continued grinding at 45.degree. C. for 10.5 hours. The result is discharged from the ATTRITOR and mixed with an amount of ISOPAR-L to form a working dispersion at about 2% solids. The toner is charged utilizing a charge director, preferably a charge director described in the above referenced U.S. Pat. No. 5,346,796 and containing 30 parts by weight lecithin, 30 parts by weight BBP and 15 parts by weight G3300 as a stabilizer. The charge director, dissolved in ISOPAR-L is added in an amount of about 30-40 mg of solids of the charge director per gram of toner solids.

A release life enhancer additive and the optional other additives, as described above, is added to this mixture in an amount sufficient to provide additives having a proportion given above in the liquid toner.

The result is a cyan toner having a relatively high voltage stability, for use in high speed printing. For other colors, suitable pigments are added in place of the pigments given above. For black toner an additional 2.5 mg/gm of stabilizer is added.

In an embodiment of the invention, a liquid toner containing the above-described additives is used in place of toner without the additives. A latent image is formed on an imaging surface, either by discharge of a photoreceptor, providing a permanent electrostatic master or by any other means known in the art. This image is developed by a liquid toner according to the invention to form a developed image. The image is transferred to an intermediate transfer member, as known in the art, and from the intermediate transfer member to a final substrate, using methods known in the art.

In an embodiment of the invention, a carrier liquid for replenishment of the toner dispersion is also provided. As is known in the art, the toner particles and carrier liquid are removed from the toner dispersion at different rates. In a preferred embodiment of the invention, a determination is made of the amount of each additive associated with the toner particles and also the amount associated with the carrier liquid. This association is defined as the percentage that is removed from the toner dispersion with the particles and with the liquid. The amounts that are removed with the liquid are believed to be the major part of the additives. Thus, in general, most of the additive will be with the carrier liquid replenisher. The amount of additives present in toner concentrate will depend on the amount of liquid in the concentrate. As system for dividing charge director in this manner is taught in U.S. Pat. No. 4,980,259, the disclosure of which is incorporated by reference. A similar system may be used for determining additives of the present invention. Thus, the range for additives in the carrier liquid replenisher is between about 80% of the lower end of the range for each additive to about the higher end of the range, although higher values may be present under some circumstances. Generally the concentration is about the same as the percentages of the ranges given above.

In an embodiment of the invention, the replenisher liquid also contains a charge director as described in U.S. Pat. No. 4,980,259.

In an embodiment of the invention, replenisher liquid is added to the toner in a printer whenever the amount of toner in a toner reservoir therein falls below some preset value. Toner concentrate (toner particles with carrier liquid, and some additives, with a high concentration of particles) is added when the concentration of toner particles in the toner in the reservoir falls below some predetermined level.

Blanket failure is typically caused by one of three failure mechanisms. These are a loss of release capability of the silicone release layer, e.g., if a condensation or additive type silicone release layer is used. A second is gloss memory (regional gloss in an image depends on whether the region was image or background in a previous print) and a third is paper jamming caused by stickiness of the release layer. Applicants have found that there is an increase of blanket life of 50% when a toner with the first release life enhancer additive and, the second additive and the third additive are used, in the proportions described above as compared to a toner with none of the additives. Use of only the third additive, as known in the prior art, is believed to increase blanket life by only about 20%.

The present invention has been described using non-limiting detailed descriptions of exemplary embodiments thereof that are provided by way of example and that are not intended to limit the scope of the invention. Variations of embodiments of the invention, including combinations of features from the various embodiments, use of other toner materials etc., will occur to persons of the art. The scope of the invention is thus limited only by the scope of the claims. The terms "comprise," "include," "have" or their conjugates, in the claims, mean "including but not necessarily limited to".

The invention claimed is:

1. A liquid toner composition or toner concentrate composition comprising:

(A) pigmented toner particles in an amount of 0.5% to 20% by weight;

(B) a carrier liquid comprising a liquid hydrocarbon;

(C) a silicone based additive;

(D) a charge director; and (E) wherein the silicone based additive comprises a liquid silicone material having a viscosity at 25° C. of at least 350,000 centistokes.

2. A composition according to claim 1 wherein the viscosity at 25° C. is at least 500,000 centistokes.

3. A composition according to claim 2 wherein the viscosity at 25° C. is at least 1,000,000 centistokes.

4. A composition according to claim 3 wherein the viscosity at 25° C. is at least 2,000,000 centistokes.

5. A composition according to claim 4 wherein the viscosity at 25° C. is about 2,500,000 centistokes.

6. A composition according to claim 1 wherein the silicone based additive is present in a ratio of between 0.001% and 0.1%, by weight to carrier liquid.

7. A composition according to claim 6 wherein the ratio is 0.002% to 0.05%.

8. A composition according to claim 7 wherein the ratio is 0.005% to 0.01%.

9. A composition according to claim 1 wherein the liquid hydrocarbon comprises a major part of a first liquid hydrocarbon and a minor part of a second hydrocarbon, where the second hydrocarbon has an evaporation rate of less than 10% of the first hydrocarbon.

10. The liquid toner composition or toner concentrate composition of claim 1 further comprising a defoaming agent.

11. A liquid toner composition or toner concentrate composition comprising:

(A) pigmented toner particles in an amount of 0.5% to 20% by weight;

(B) a carrier liquid comprising a liquid hydrocarbon;

(C) a silicone based additive;

(D) a charge director;

(E) wherein the silicone based additive comprises a liquid silicone material having a viscosity at 25° C. of over 5,000 centistokes; and (F) wherein the silicone based additive is present in a ratio of between 0.005% to 0.01%, by weight to carrier liquid.

12. The liquid toner composition or toner concentrate composition of claim 11 further comprising a defoaming agent.

13. A liquid toner composition or toner concentrate composition comprising:

(A) pigmented toner particles in an amount of 0.5% to 20% by weight;

(B) a carrier liquid comprising a liquid hydrocarbon;

(C) a silicone based additive, wherein the silicone based additive comprises a release life enhancer which is a silicone gum; and (D) a charge director.

14. A liquid toner composition or toner concentrate composition according to claim 13 wherein the silicone gum comprises a polydimethyldiphenylmethylvinylsilioxane gum.

15. The liquid toner composition or toner concentrate composition of claim 13 wherein the silicone based additive is present in a ratio of between 0.005% to 0.01%, by weight to carrier liquid.

16. A liquid toner composition or toner concentrate composition comprising:

(A) pigmented toner particles in an amount of 0.5% to 20% by weight;

(B) a carrier liquid comprising a liquid hydrocarbon;

(C) a silicone based additive;

(D) a charge director;

(E) wherein the silicone based additive comprises a release life enhancer selected from the group consisting of:

(a) a liquid silicone material having a viscosity at 25° C. of over 5,000 centistokes;

(b) a silicone gum; and (c) an alkyl modified non-reactive silicone fluid present in a ratio of between 0.01% and 2%, by weight to carrier liquid; and (F) a defoaming agent.

17. A composition according to claim 16 wherein the defoaming agent is present in a ratio of 0.0002%-0.002% by weight of non-volatile solids in the defoaming agent with respect to the carrier liquid.

18. A composition according to claim 16 wherein the defoaming agent comprises a gel.

19. A composition according to claim 18 wherein the gel is a finely ground gel.

20. A composition according to claim 16 wherein the defoaming agent comprises Dimethicone/Vinyl Dimethicone Crosspolymer with Cyclopentasilicone.

* * * * *